US006276849B1

(12) United States Patent
Feitel et al.

(10) Patent No.: US 6,276,849 B1
(45) Date of Patent: Aug. 21, 2001

(54) PRINTER SPOOL AND SPOOL DRIVE CONE HAVING RADIALLY EXTENDING TEETH

(75) Inventors: Mark A. Feitel, Plymouth; Scott C. Milton, Maplewood, both of MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 09/349,825

(22) Filed: Jul. 8, 1999

(51) Int. Cl.[7] ..... B65H 75/18

(52) U.S. Cl. ..... 400/242; 400/246; 400/208.1; 242/571.4; 242/596; 242/596.7

(58) Field of Search ..... 400/242, 246, 400/224.2, 208.1, 208, 207; 242/571.4, 596, 596.7, 538.1, 545

(56) References Cited

U.S. PATENT DOCUMENTS

| | | | | |
|---|---|---|---|---|
| 3,955,770 | * | 5/1976 | Offermann | 242/596 |
| 4,178,094 | | 12/1979 | Silverberg | 355/16 |
| 4,440,248 | | 4/1984 | Teraoka | 177/4 |
| 4,501,224 | | 2/1985 | Shibayama et al. | 118/697 |
| 4,625,902 | | 12/1986 | Billberg | 226/2 |
| 4,630,538 | | 12/1986 | Cushman | 101/45 |
| 4,655,129 | | 4/1987 | Wirth et al. | 101/35 |
| 4,673,304 | * | 6/1987 | Liu et al. | 400/208 |
| 4,697,756 | * | 10/1987 | Kofler | 242/596 |
| 4,768,039 | | 8/1988 | Akutagawa et al. | 346/76 |
| 5,174,667 | * | 12/1992 | Sugimoto et al. | 400/207 |
| 5,496,121 | | 3/1996 | Gunderson | 400/692 |
| 5,727,883 | * | 3/1998 | Kusano et al. | 400/246 |

* cited by examiner

*Primary Examiner*—Ren Yan
*Assistant Examiner*—Leslie J. Grohusky
(74) *Attorney, Agent, or Firm*—Quarles & Brady LLP

(57) ABSTRACT

A thermal transfer printer including a chassis having opposing side frame members. A pair of cones are each rotatably mounted to one of the opposing side frame members. At least one of the cones has a convex surface with one or more teeth formed thereon. A spool is supported between the pair of cones, wherein the cone teeth engage an end of the spool for rotatably driving the spool. The spool has an elongated body with outwardly extending crush ribs which hold labeling media or ink ribbon thereon.

22 Claims, 10 Drawing Sheets

PRINTER SPOOL AND SPOOL DRIVE CONE HAVING RADIALLY EXTENDING TEETH

TECHNICAL FIELD

The present invention relates to a printer spool, and more particularly to a thermal printer spool for holding a core with labeling media or ink ribbon disposed thereon, and engaging a printer spool drive subassembly.

DESCRIPTION OF THE BACKGROUND ART

There are a number of U.S. patents that disclose electronic apparatus for printing indicia on labels, some of which are described in U.S. Pat. Nos. 4,440,248, Teraoka; 4,501,224, Shibayama; 4,630,538, Cushing; and 4,655,129, Wirth et al.

The electronic machines for printing labels of the type disclosed above all include the same general combination of elements, a print head, means for feeding labeling media to be printed past the print head, a microprocessor, a read only memory programmed with appropriate instructions to operate the microprocessor, a random access memory, a keyboard with letter, number, and function keys for the entry of alphanumeric information concerning the indicia to be printed, and a visual display such as a LED/LCD unit to assist the operator in using the machine.

The labeling media comprises a roll of pressure sensitive tape (continuous media or die cut labels)that is attached to a continuous roll of release liner. The labeling media is fed through the printer and legends are printed on the tape. Labels are formed using the continuous tape by cutting the media after the legends are printed thereon. The labels are then removed from the release liner and attached to the objects needing identification. As there are many types of label applications, there are many combinations of tape and release liners that provide labels of varying sizes, colors, formats, and environmental resistance.

A particular type of print head employs thermal transfer printing technology. Thermal transfer printing uses a heat generating print head to transfer a colored coating containing wax, carbon black, or the like, from a thermal transfer ribbon to a labeling media. By using digital technology, characters are formed by energizing a sequence of pixels on the print head which in turn melt the coating on the ribbon transferring the image to the labeling media.

In a known thermal transfer printer such as a label printer, labeling media is fed by a platen roller simultaneously with a ribbon feed roller feeding an ink transfer ribbon. While the labeling media driven by the platen roller runs between the print head and the rotating platen roller, the transfer ribbon is passed between the print head and the platen roller by rotating the ribbon feed roller. As a result, the labeling media and the transfer ribbon pass together in overlay relationship between the print head and the platen roller.

The labeling media is fed past the print head from a supply spool driven by a labeling media drive subassembly. The labeling media drive subassembly has a drive side driving the roller, and a free wheel side which is not driven. Typically, the labeling media is justified to the drive side within the printer, and the free wheel side is adjusted to the width of the media. Justifying the labeling media to one side within the printer causes the labeling media to be off center to that of the print head. This causes an upset at the printer dot line, and an uneven pressure loading of the print head resulting in poor print quality.

One solution to justifying the labeling media to one side is to adjust the drive side and the free wheel side such that the labeling media is centered on the print head. However, an adjustable drive mechanism is expensive.

Furthermore, typical printer spools require a locking mechanism to ensure proper drive system engagement. This complicates engaging and disengaging the spool from the printer drive systems. These drive systems are also subject to slipping (i.e., torque out) which can cause the printer to jam. Therefore, a need exists for an improved printer drive system and spool.

SUMMARY OF THE INVENTION

The present invention provides a thermal transfer printer including a chassis having opposing side frame members. A pair of cones are each rotatably mounted to one of the opposing side frame members. At least one of the cones has a convex surface with at least one tooth formed therein. A spool is supported between the pair of cones, wherein the cone teeth engage an end of the spool for rotatably driving the spool.

The present invention accomplishes the general objective of providing a spool drive system which positively engages the spool to reduce torque out. This objective is accomplished by providing a drive cone having a convex surface and teeth formed thereon to rotatably drive the spool.

Another objective of the present invention is to provide a printer spool which positively engages the printer cones. This objective is accomplished by providing a spool which includes an elongated member with opposing ends, and a sprocket disposed on at least one end for engaging the cone.

Still another objective of the present invention is to provide a spool having a sprocket which fully engages a toothed cone when the spool and cone are initially misaligned. This objective is accomplished by providing the cone or spool sprocket with rounded teeth with radially extending tips, each tip having a rounded radial surface, which slip into place for full engagement once a rotational force is applied either manually or by the stepping motor.

Yet another objective of the present invention is to provide a printer spool for use with labeling media or ink ribbon which properly locates the labeling media or ink ribbon in the printer. This objective is accomplished by providing a spool with crush ribs which hold the labeling media or ink ribbon on the spool.

These and still other objects and advantages of the present invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

DETAILED DESCRIPTION OF THE PREFERRED EMBODIMENTS

Figure 1:
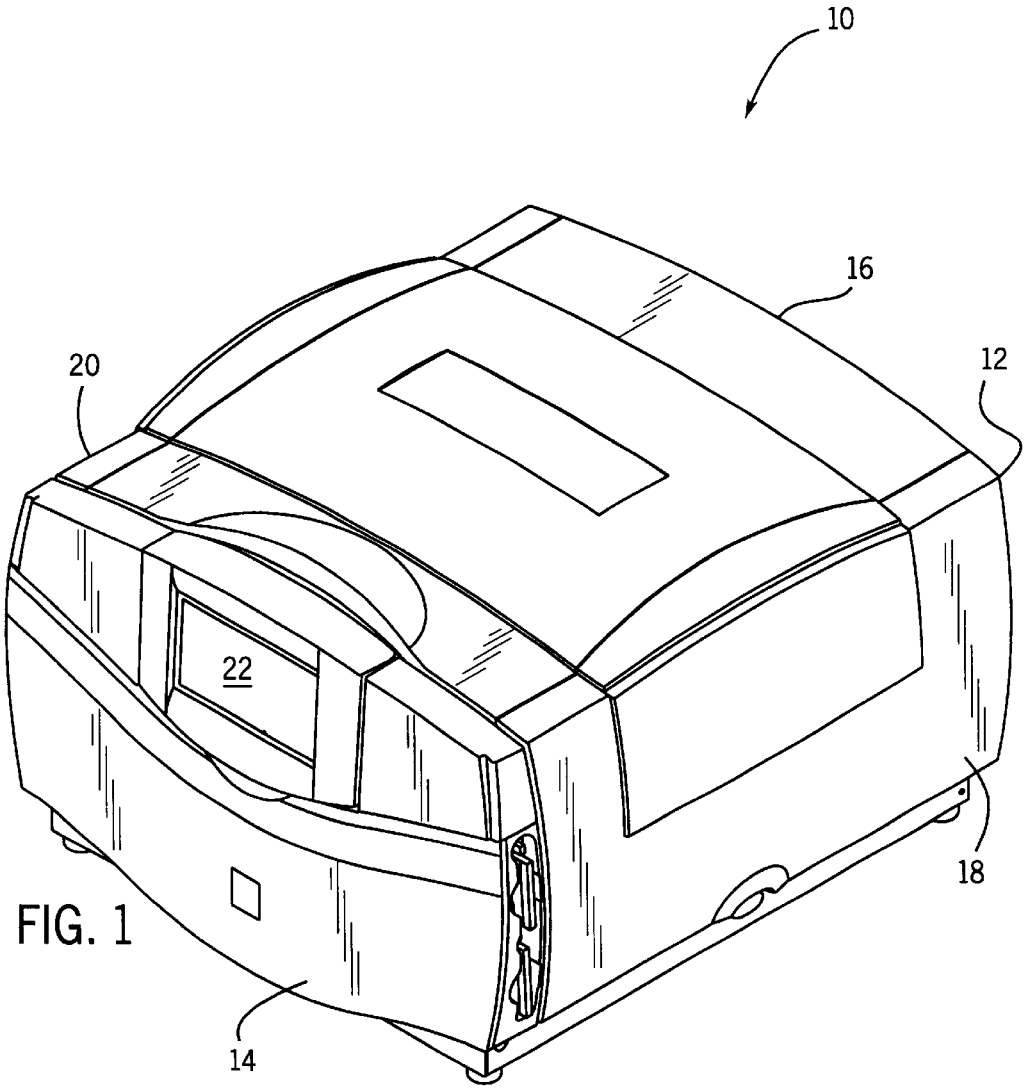
FIG. 1 is a front, right side perspective view of a thermal transfer printer which employs the present invention.

As shown in FIGS. 1–8, a thermal transfer printing machine 10 which employs the preferred embodiment of the present invention includes a molded plastic housing 12 having a front 14, opposing sides 18, 20, and a metal back 16. The housing 12 encloses printer subassemblies 28, 30, 32, 34, and 36 mounted on a chassis 38 (shown in FIGS. 3–5), and supports a LCD display 22 pivotally mounted to the housing front 14. Labels 43 printed on labeling media 40 are ejected from the printer 10 down an exit chute 24, and through an opening 26 formed in the housing side 20. The LCD display 22 displays printer status and error indicators to a user. Printer circuitry 44 mounted to the chassis 38 controls the printer subassemblies 28, 30, 32, 34, and 36 and powers the LCD display 22.

Referring to FIGS. 2–5, the printer chassis 38 is supported by a substantially rectangular base 46 which provides the foundation for the printer 10. The base 46 has a top 48, bottom 50, and sides 52. Four feet 54 mounted in each corner of the base bottom 50 support the base 46. The housing 12 is attached to the base 46 with screws (not shown) threadably engaging clips 55 extending from the base sides 52.

The chassis 38 supports the subassemblies 28, 30, 32, 34, and 36, and has a bottom frame 53 mounted to the printer base top 48, and a top frame 56 pivotally mounted to the bottom frame 53. Looking particularly at FIG. 4, the chassis bottom frame member 53 includes a pair of opposing frame side members 58 mounted to the base top 48 (shown in FIG. 3)using screws or the like, and supports a labeling media drive subassembly 28, a cutter subassembly 34, and a label eject subassembly 36. Looking particularly at FIGS. 5 and 6, the chassis top frame 56 has an end frame member 60 joining a pair of opposing frame side members 62 which support a print head subassembly 30 and a thermal transfer ink ribbon subassembly 32.

Figure 7:
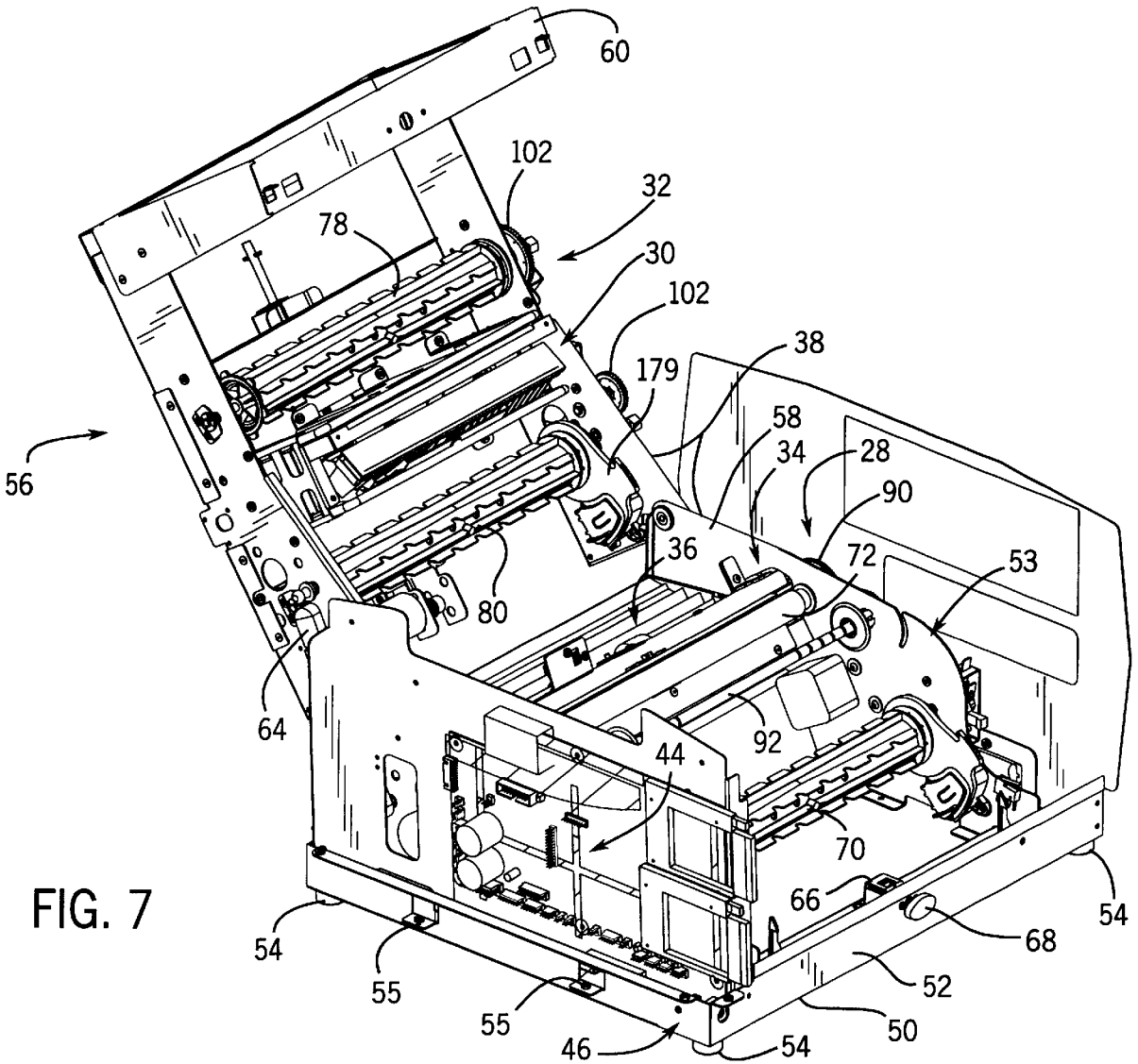
FIG. 7 is a front, right perspective view of the printer in an open configuration.

As shown in FIG. 7, pivotally mounting the top frame 56 allows the user to open the chassis 38 in a clam-shell fashion exposing the subassemblies 28, 30, 32, 34, and 36 for easy maintenance. A pneumatic piston 64 mounted to the top and bottom frames 56,53 restricts the chassis 38 from opening too quickly and damaging the subassemblies 28, 30, 32, 34, and 36 from jarring. Looking at FIG. 7, a latch 66 mounted to the base side 52 catches the chassis top frame member 60 to hold the chassis 38 in the closed position during printer operation, and is released by a button 68 mounted to the base side 52.

Referring back to FIGS. 3 and 4, the labeling media drive subassembly 28 feeds labeling media 40 from the rotatably mounted labeling media supply spool 70 past the print head assembly 30. The labeling media 40 is comprised of a release liner 41 which supports an adhesive backed material, such as labels 43 or a continuous sheet of vinyl or polyester. The size, color, and type of label material carried by the spool 70 varies depending upon the particular print application.

The labeling media 40 unrolls off the spool 70 as it is driven by the labeling media drive subassembly 28. The labeling media drive subassembly 28 includes a master drive cone 84 (shown in FIG. 8) rotatably mounted to one of the chassis bottom frame side members 58, and a slave cone 86 rotatably mounted to the opposing chassis bottom frame side member 58. The cones 84,86 support the labeling media supply spool 70 therebetween. Springs (not shown) urge at least one of the cones toward the opposing side frame member. When the springs are compressed, the cones 84, 86 spread apart to allow easy loading of the spool 70. A stepping motor 88, mounted to the same frame member 58 as the master drive cone 84, rotatably drives the master drive cone 84 to dispense labeling media 40 from the supply spool 70. A stepping motor gear mechanism 90 driven by the stepping motor 88 drives an idler roller 92 and the platen 72 to feed the labeling media 40 past the print head subassembly 30.

Figure 3:
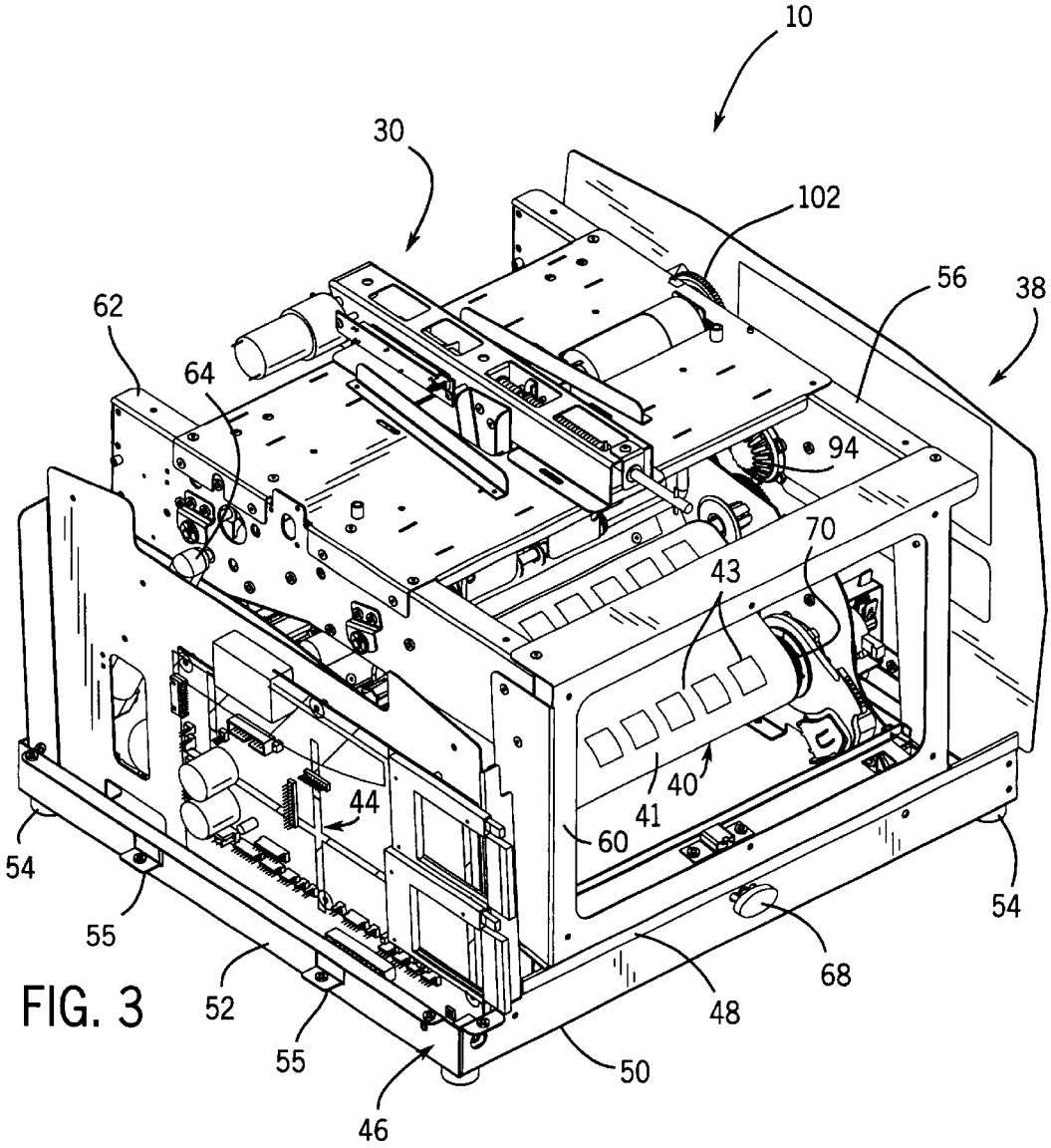
FIG. 3 is a front, right side perspective view of the printer of FIG. 1 with the housing removed.
Figure 9:
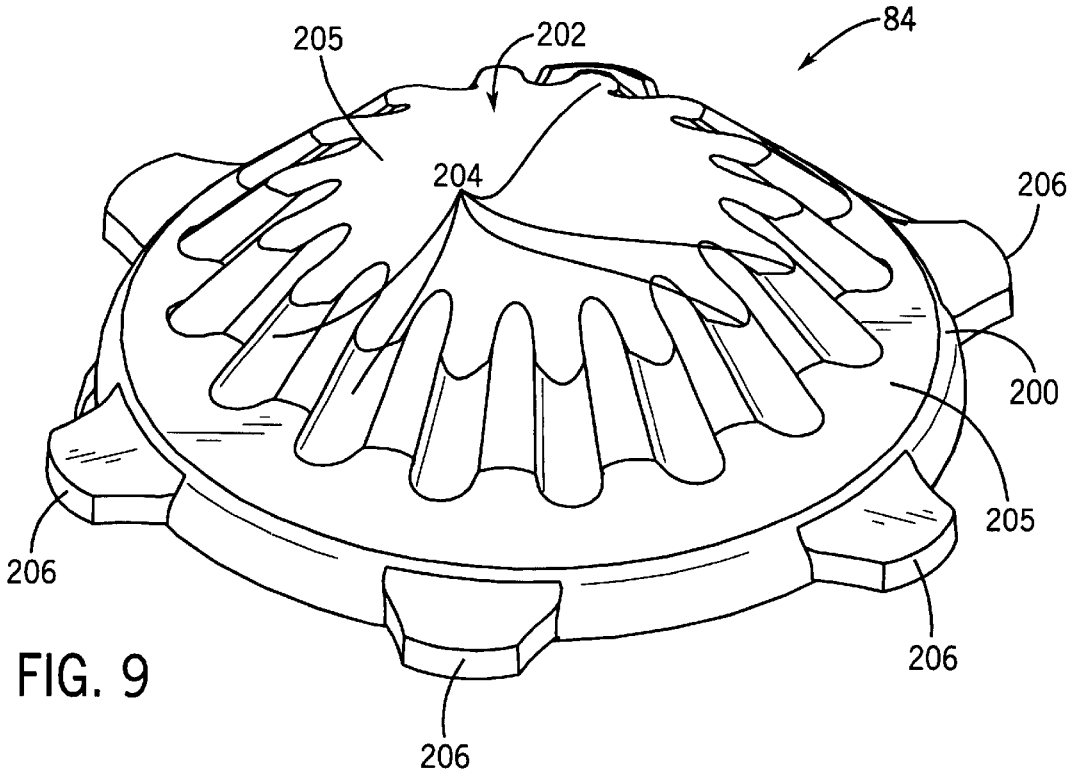
FIG. 9 is a perspective view of a cone of FIGS. 4 and 5.
Figure 11:
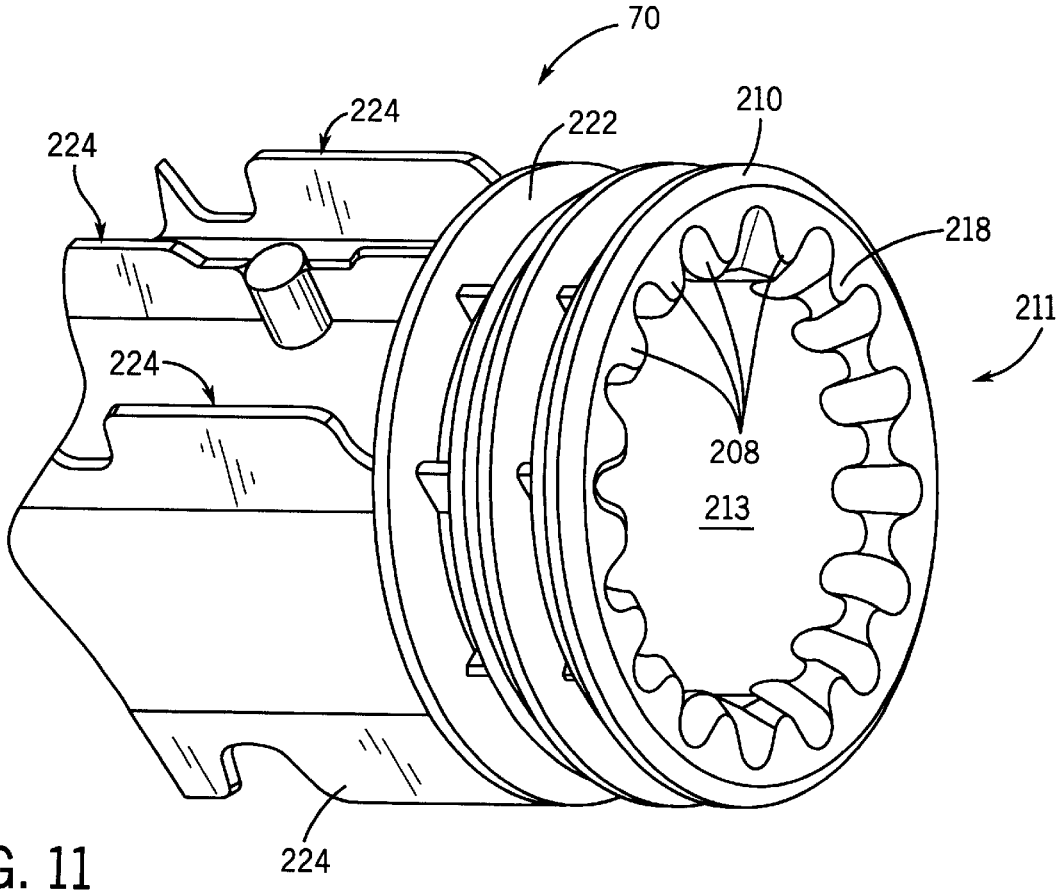
FIG. 11 is an enlarged perspective view of an end of the spool of FIG. 10.
Figure 10:
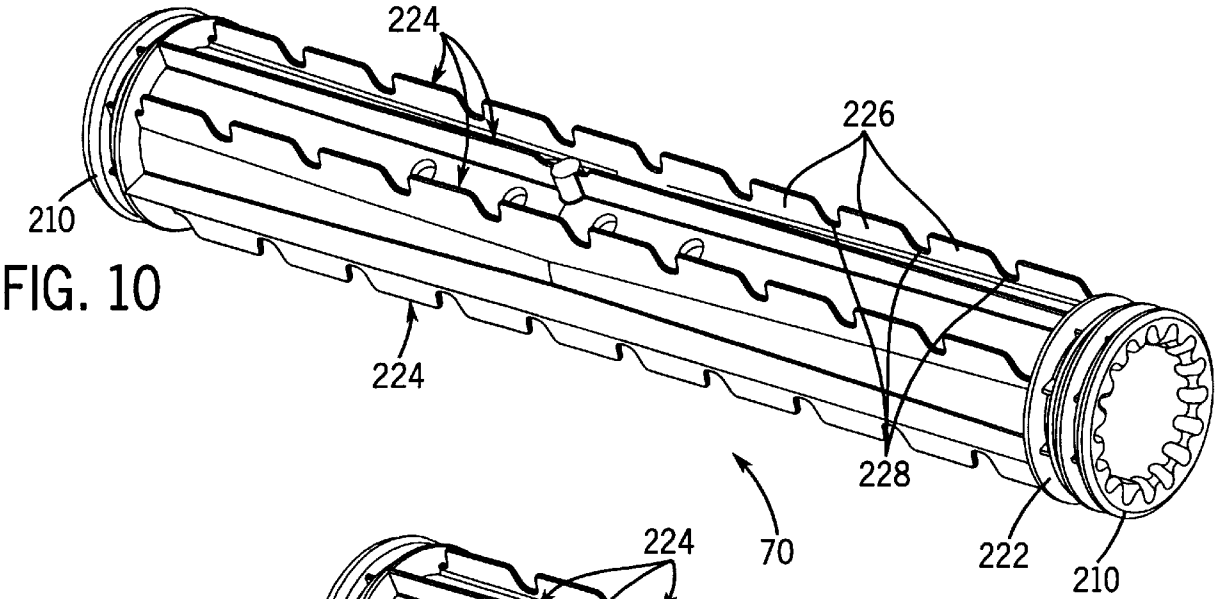
FIG. 10 is a perspective view a spool of FIG. 7.
Figure 12:
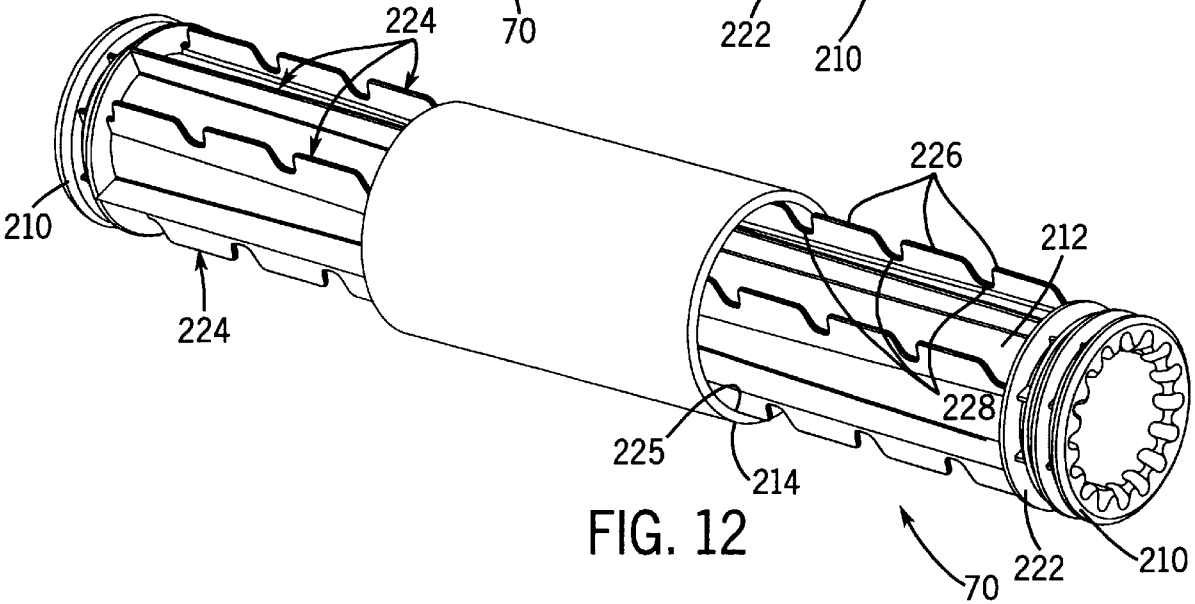
FIG. 12 is a perspective view of the spool of FIG. 10 with a core slipped thereon.

Referring to FIGS. 9–11, the master drive cone 84 mates with a socket 211 on one end of the labeling media supply spool 70 to drive the spool 70, and maintain tension in the labeling media 40 (shown in FIG. 3). The drive cone 84 has a disc shaped body 200 with a convex surface 202. The convex surface 202 has a rounded tip 203 surrounded by a circular skirt 205 and a plurality of teeth 204. The evenly spaced teeth 204 extend from the rounded tip to the skirt. Sprocket handles 206 formed on the cone perimeter allow for manual tensioning of the labeling media 40 when it is mounted in the printer 10.

The drive cone teeth 204 engage a like number of teeth 208 (shown in FIG. 11) formed in the supply spool socket 211 to rotatably drive the spool 70. Preferably, four or more teeth are formed on the cone surface 202 to positively drive the spool 70. Most preferably, sixteen or more teeth are provided to minimize the tooth penetration into the spool end 210 necessary to positively drive the spool 70.

The teeth 204 are rounded (i.e., no sharp edges) to provide a positive locking mechanism when engaging a spool socket having a complimentary geometry while allowing an initial mismatch between the geometries. If a mismatch occurs (i.e., the teeth do not fully engage), the rounded teeth 204 guide the spool end socket to fully seat in the cone 84 once a rotational force is applied either manually or by the stepping motor 88.

Figure 4:
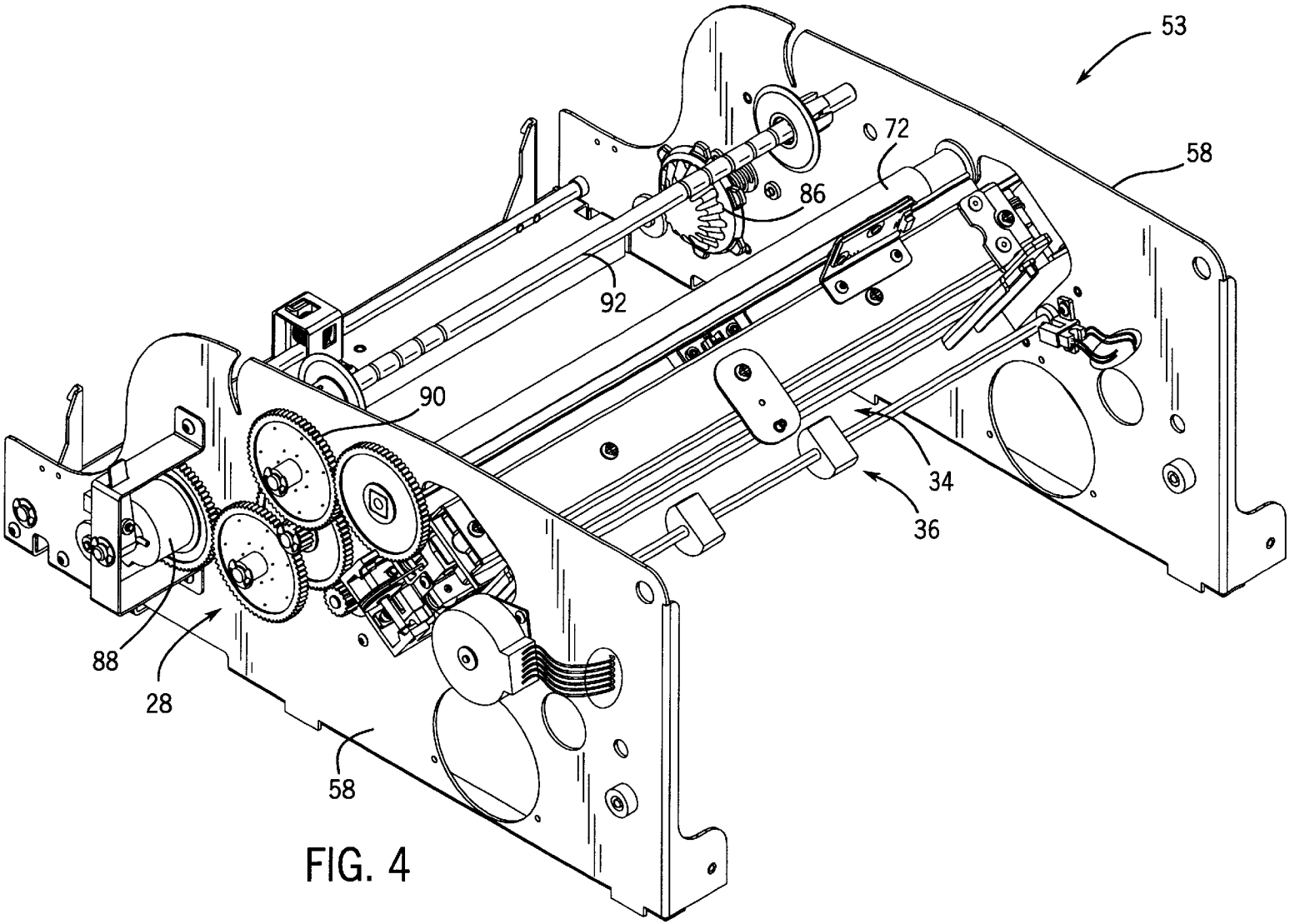
FIG. 4 is a rear, left side perspective view of the printer chassis lower frame of FIG. 3.
Figure 5:
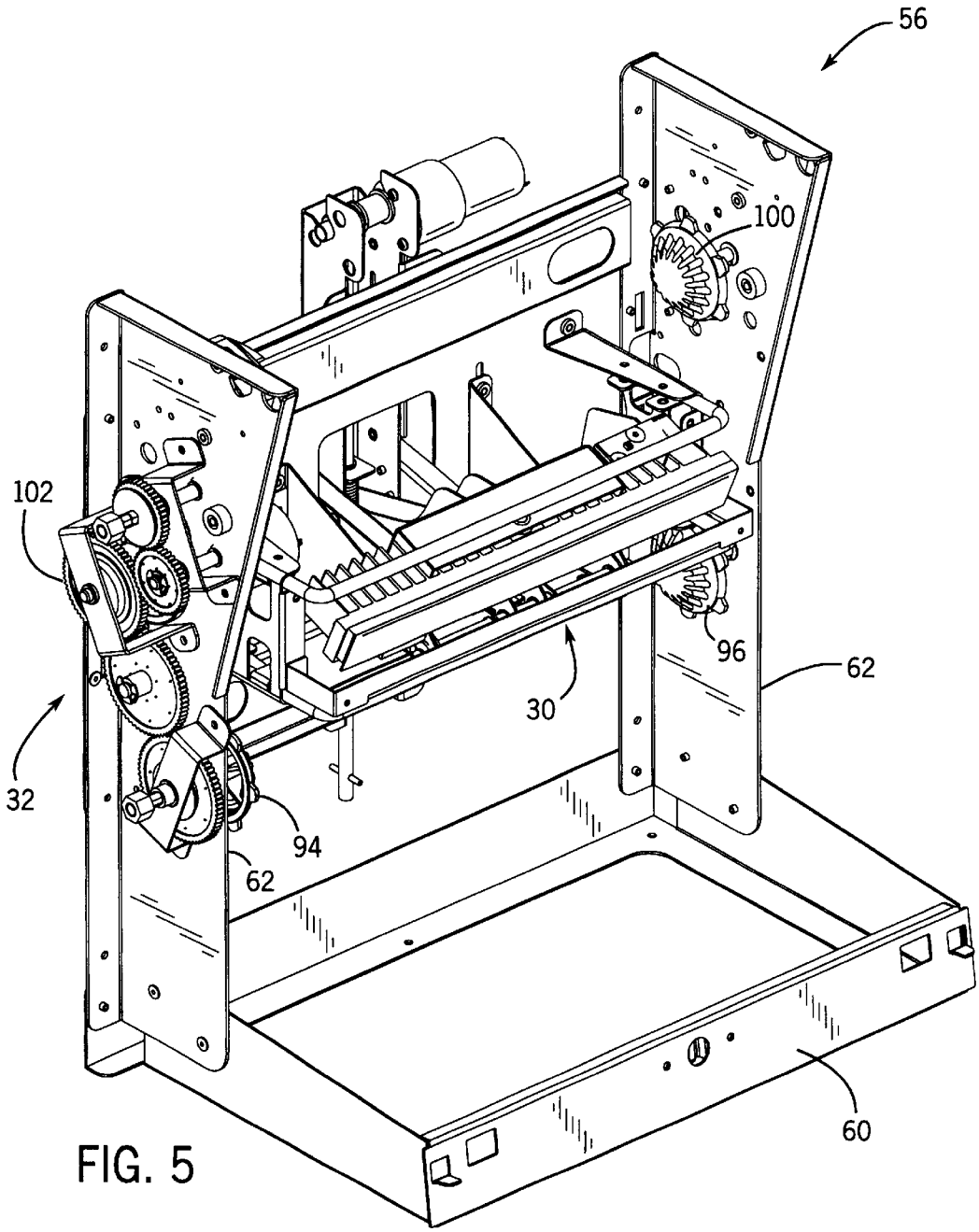
FIG. 5 is a bottom, left side perspective view of the printer chassis top frame of FIG. 3.
Figure 6:
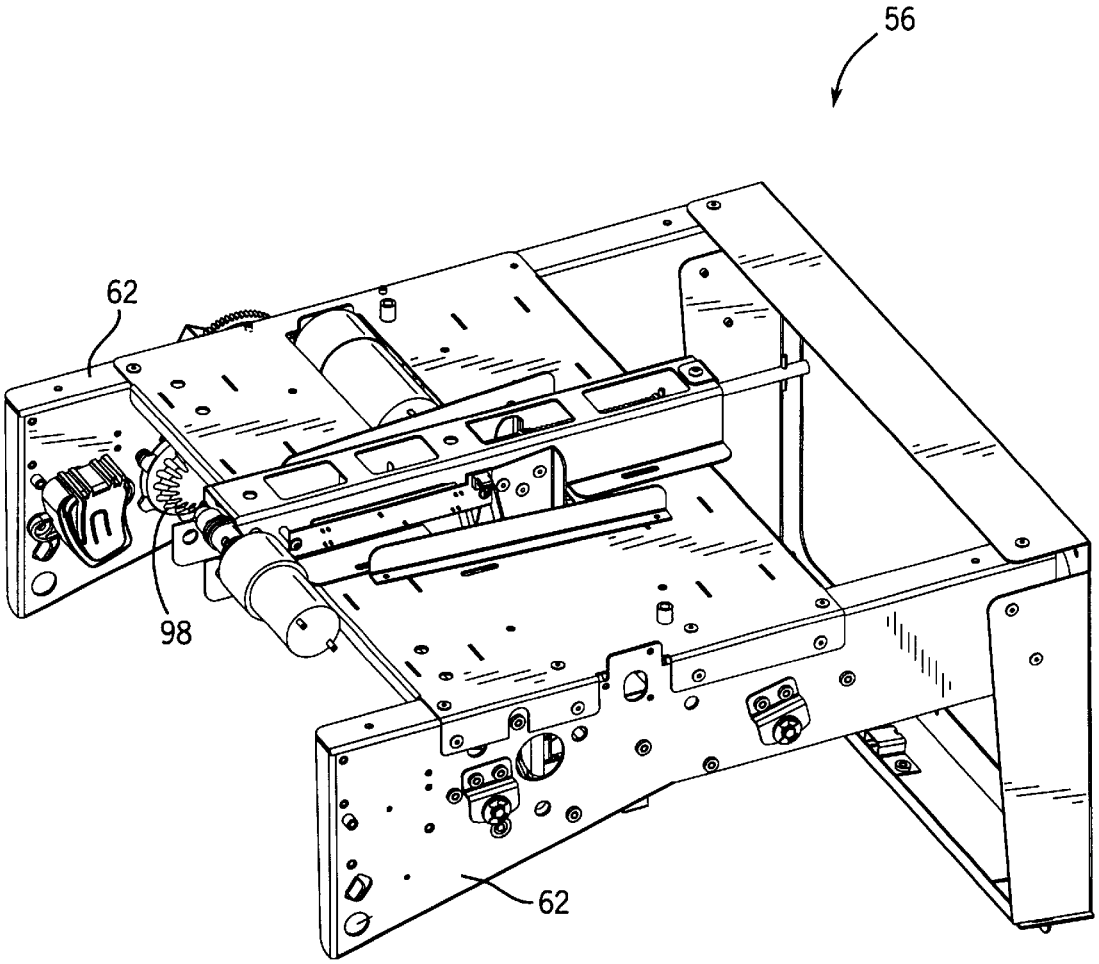
FIG. 6 is a top, right side perspective view of the printer chassis top frame of FIG. 3.

As shown in FIGS. 4, 9, and 10, the slave cone 86 is substantially similar to the master drive cone 84, thus eliminating the need to supply a spool 70 having dissimilar ends. However, the slave cone 86 is free-wheeling (i.e., the slave cone is not driven by the stepping motor 88, rather it is rotated by the driven spool 70).

As shown in FIGS. 3, 10–12, the labeling media supply spool 70 includes an elongated tubular body 212 with opposing ends 210. The body 212 supports a labeling media core 214 having labeling media 40 wrapped thereon. The core 214 with the labeling media 40 is slipped over the spool body 212, and supplies the printer 10 with the labeling media 40. Each spool end 210 has a socket 211 which mates with one of the labeling media drive subassembly cones 84, 86 (shown in FIGS. 4 and 8). A groove 222 is formed proximal at least one spool end 210 for slidably attaching a chip holder, such as disclosed in copending U.S. Patent Application entitled "PRINTER WITH VARIABLE PLATEN PRESSURE", filed concurrently with the present application, and which is fully incorporated herein by reference.

Each spool end socket 211 (best shown in FIG. 11) has an annular end face 218 which surrounds a central recess 213. A set of rounded teeth 208 are formed in the end socket 211, and extend radially inward from the annular end face 218. The rounded cone tip 203 is received in the recess 213, and the cone teeth 204 engage and mate with the rounded socket teeth 208. By rounding the socket teeth 208, the spool sockets 211 will more readily fully seat in the cone 84,86.

The tubular supply spool body 212 has outwardly extending crush ribs 224 which hold the labeling media core 214 in position for the printer 10. The ribs 224 are formed as an integral part of the spool body 212 using methods known in the art such as injection molding using a resilient material, such as high impact polystyrene. Each rib 224 extends longitudinally along the spool length, and is divided into sections 226 by notches 228 which aid in centering and retaining the core 214 on the spool 70.

A labeling media core 214 slipped over the spool body 212 compresses the ribs which impinge against a core interior surface 225. The compressed ribs 224 exert a radially outward directed force against the core interior surface 225 to frictionally hold the core 214 on the spool 70, and prevent the core 214 from slipping on the spool 70 longitudinally and circumferentially. The rib sections 226 not compressed by the labeling media core 214 extend radially outward past the core 214, and position the core 214 on the spool 70 for printing.

Referring to FIGS. 4–8, the thermal transfer ink ribbon drive subassembly 32 is mounted to the chassis top frame 56, and feeds the thermal transfer ink ribbon 76 past the print head subassembly 30 from an ink ribbon supply spool 78 to an ink ribbon take up spool 80. The ink ribbon drive subassembly 32 includes an ink ribbon supply spool master drive cone 94 and opposing slave cone 96, an ink ribbon take up spool master drive cone 98 and opposing slave cone 100, and a gear mechanism 102 for rotatably driving the master drive cones 94,98.

As in the labeling media drive subassembly 28, each ink ribbon spool 78,80 is supported at its ends by the master drive cone 94,98 and the opposing slave cone 96,100 which are substantially similar to the labeling media drive subassembly master drive and slave cones 84,86. Advantageously, by providing substantially similar cones, the cones are interchangeable, thus reducing the number of different parts in the printer.

The ink ribbon drive subassembly master drive cones 94,98 are rotatably driven by the gear mechanism 102 mounted on one side of the top frame side member 62 to rotatably drive the take up spool 80 and pull the ink ribbon 76 past the print head 74. The gear mechanism 102 is mounted on the same top frame side member 62 as the master drive cones 94,98, and engages the labeling media drive gear mechanism 90 to provide synchronous movement of the labeling media 40 and ink ribbon 76 past the print head 74.

The ribbon supply and take-up spools 78,80 are substantially identical to the labeling media supply spool 70 with the exception that ink ribbon 76 is wound on cores slipped over the spool body. Each ribbon supply and take-up spool 78, 80 includes a tubular body and body ends such as described for the labeling media supply spool 70.

Figure 8:
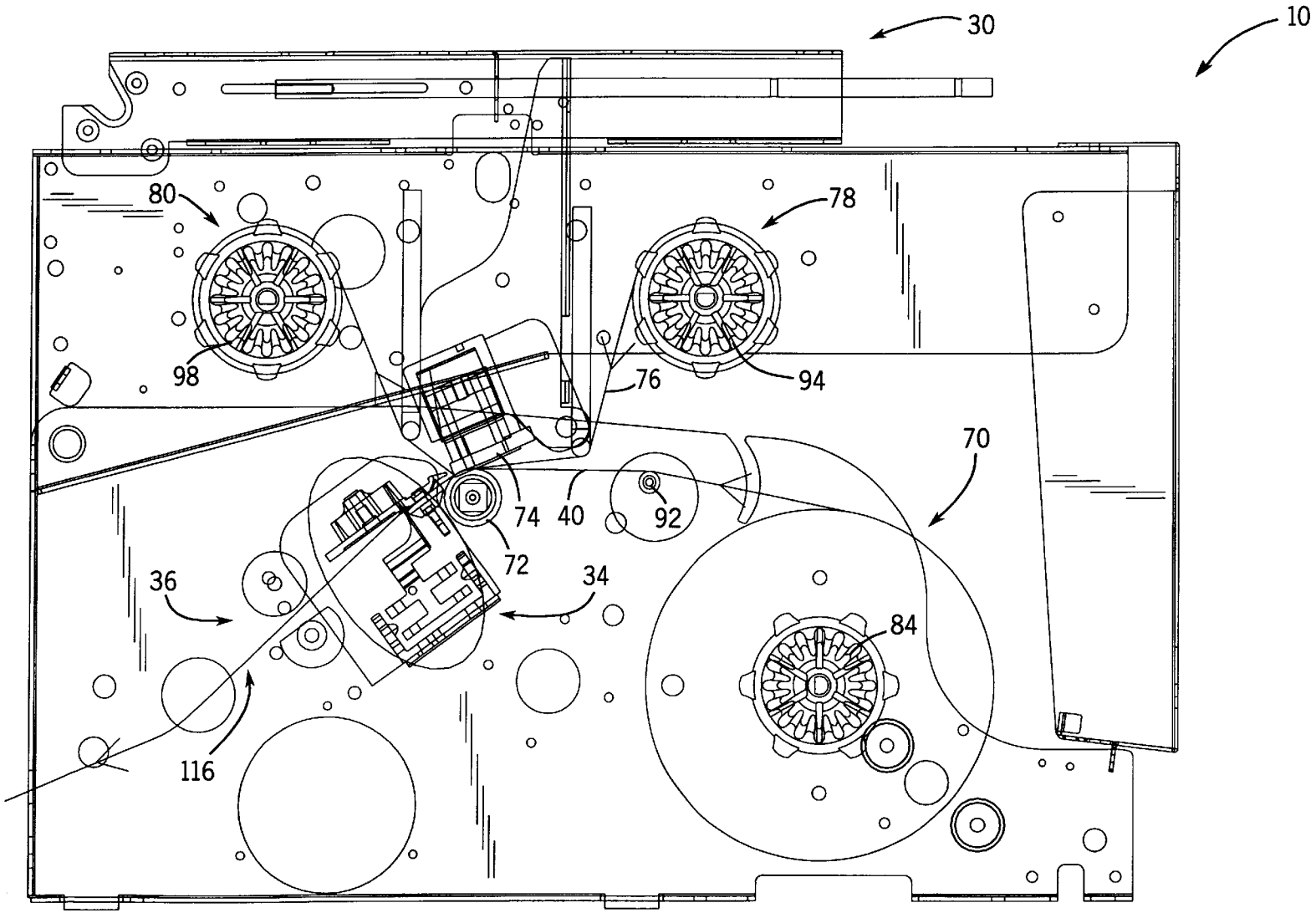
FIG. 8 is a sectional elevation view of FIG. 3 showing the media and ribbon paths.

As shown in FIGS. 7 and 8, the print head subassembly 30 in the printer 10 is arranged to cooperate with the thermal transfer ribbon 76 and the labeling media 40 such that the thermal print head 74 can print characters or symbols on the labeling media 40. Thermal transfer printing is described in greater detail in U.S. Pat. No. 5,078,523 which is incorporated herein by reference.

The labeling media 40 and ribbon 76 are advanced past the print head subassembly 30 by the platen 72 which urges the ribbon 76 and labeling media 40 in close cooperation with the print head 74. The print head subassembly 30 is fully described in a copending U.S. Patent Application entitled "PRINTER WITH VARIABLE PLATEN PRESSURE", filed concurrently with the present application, and which is fully incorporated herein by reference.

Figure 2:
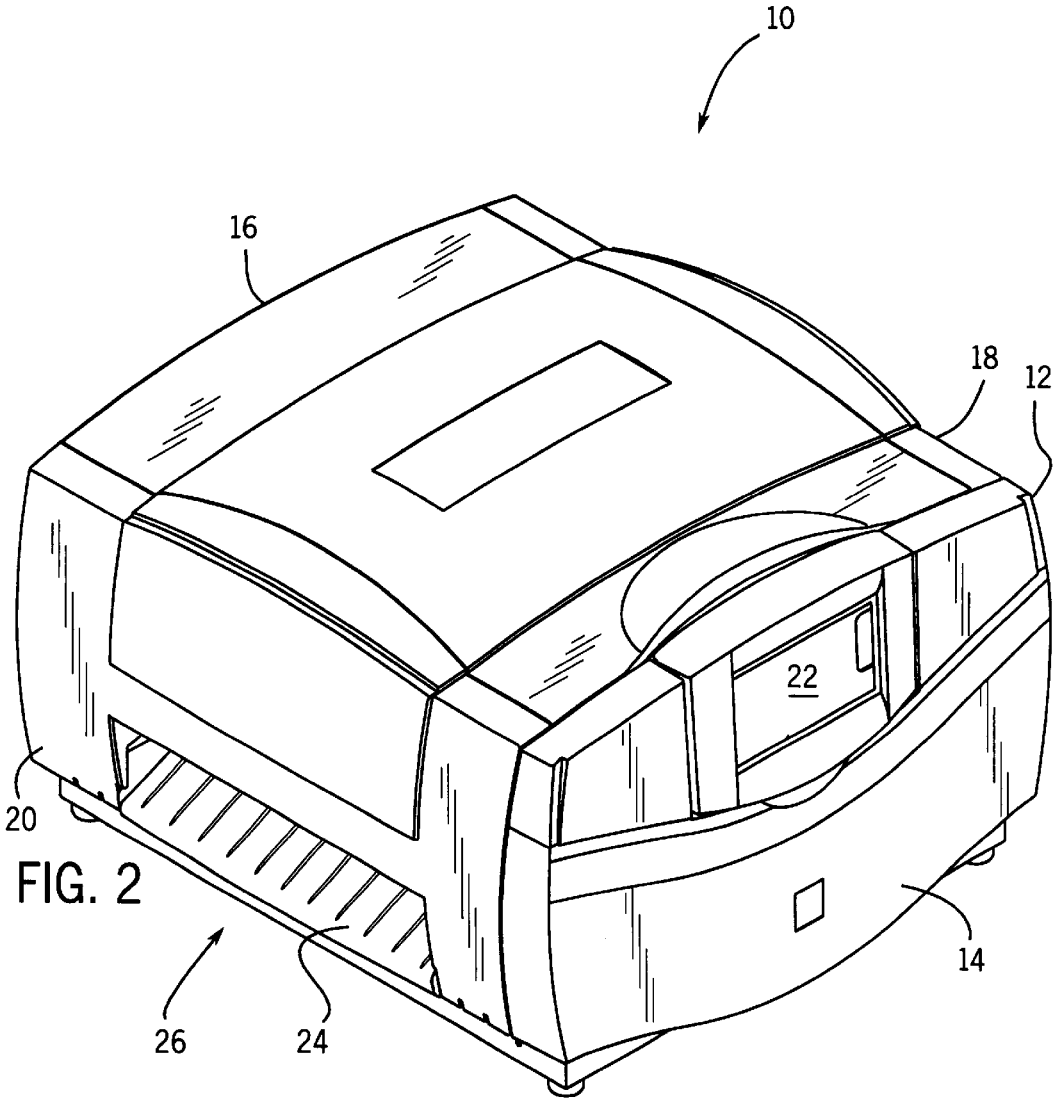
FIG. 2 is a front, left side perspective view of the printer in FIG. 1.

Once the print head subassembly 30 prints on the labeling media 40, the labeling media drive subassembly 28 advances the printed labeling media 116 past the cutter subassembly 34. The cutter subassembly 34 cuts the printed labeling media 116 which is ejected by the label eject subassembly 36 down the exit chute 24, and out of the housing opening 26 (chute 24 and exit housing 26 are shown in FIG. 2). The cutter subassembly 34 and label eject subassembly 36 are fully described in a co-pending U.S. patent application entitled "PRINTER WITH CUTTER EJECT SYSTEM," filed concurrently with the present application, and which is fully incorporated herein by reference.

While there has been shown and described what are at present considered the preferred embodiment of the invention, it will be obvious to those skilled in the art that various changes and modifications can be made therein without departing from the scope of the invention defined by the appended claims.

We claim:

1. A printer spool comprising:

an elongated body having ends; and a socket formed in one body end for engaging a printer drive cone; and one or more teeth extending from said socket for engaging said cone, each of said teeth having a radially extending tip each tip having a rounded radial surface which guides the cone into engagement with said socket.

2. The printer spool as in claim 1, including a plurality of crush ribs formed on the body, and extending radially outwardly therefrom along a substantial portion of its length, the crush ribs being deformable when a cylindrical core is slipped over said cylindrical body to retain the core on the body.

3. The printer spool as in claim 2, in which said ribs extend longitudinally along the length of the body.

4. The printer spool as in claim 2, including a notch formed in one of said ribs for dividing said rib into sections, one of said sections extending outwardly past said cylindrical core when the core is received around the spool to stop the core from slipping longitudinally on said spool.

5. The printer spool as in claim 2, wherein said ribs are formed from high impact polystyrene.

6. The printer spool as in claim 1, wherein said body is cylindrical.

7. The printer spool as in claim 1, in which said teeth extend radially inwardly for engagement with teeth extending radially outwardly from the cone.

8. In a printer having a spool drive subassembly for rotatably driving a spool, a spool drive cone for driving said spool in said printer, said spool drive cone comprising:

a conical shaped body for engaging a spool end, and one or more teeth extending from a surface of said body, each of said teeth having a radially extending tip, each tip having a rounded radial surface which guides said body into engagement with teeth formed in the spool end.

9. The spool drive cone as in claim 8, in which the body has a rounded tip for guiding said cone into said socket, said tip being surrounded by a circular skirt and said teeth, and said teeth extending between said tip and said skirt.

10. The spool drive cone as in claim 8, including four or more of said teeth.

11. The spool drive cone as in claim 8, including sixteen or more of said teeth.

12. The spool drive cone as claimed in claim 8 in which the teeth are equally spaced.

13. The printer spool as in claim 8, in which said teeth extend radially outwardly for engagement with teeth extending radially inwardly from the spool end.

14. A thermal transfer printer comprising:

a chassis having opposing side frame members;

a spool disposed between said frame members, and having spool ends;

a pair of spool support cones, each cone supporting one of said spool ends and being rotatably mounted to one of said opposing side frame members;

one or more teeth extending radially outwardly from a surface of one of said support cone and spool end, and each of said teeth having a radially extending tip each tip having a rounded radial surface; and one or more teeth extending radially inwardly from a surface of the other of said support cone and spool end, and each of said radially inwardly extending teeth having a radially extending tip each tip having a rounded radial surface, wherein said radially inwardly extending teeth engage said radially outwardly extending teeth for rotatably driving said spool, and said tips guide said teeth into engagement when said teeth are misaligned.

15. The printer as claimed in claim 14, including four or more teeth extending from one of said support cone and spool end.

16. The printer as claimed in claim 14, including sixteen or more teeth extending from one of said support cone and spool end.

17. The printer as claimed in claim 14, wherein said cones are substantially similar.

18. The printer as in claim 14, wherein said spool includes an elongated body for receiving a cylindrical core which extends around the body and along a substantial part of the length of the body.

19. The printer as in claim 18, including a plurality of crush ribs formed on the spool body and extending radially outward therefrom to engage the cylindrical core, the crush ribs being formed to compress when the cylindrical core is received around the spool body.

20. The printer as in claim 19, including a notch formed in one of said ribs for dividing said rib into sections, one of said sections extending outwardly past said cylindrical core when the core is received around the spool to stop the core from slipping longitudinally on said spool.

21. The printer as in claim 19, wherein said ribs are formed from high impact polystyrene.

22. The printer as in claim 18, wherein said spool body is cylindrical.

* * * * *